US005664762A

United States Patent [19]

Rothbauer

[11] Patent Number: 5,664,762

[45] Date of Patent: Sep. 9, 1997

[54] AUTOMOTIVE SCREW JACK

[75] Inventor: Thomas D. Rothbauer, Laporte, Ind.

[73] Assignee: Ausco Products, Inc., Benton Harbor, Mich.

[21] Appl. No.: 710,036

[22] Filed: Sep. 11, 1996

[51] Int. Cl.[6] ..... B66F 3/18

[52] U.S. Cl. ..... 254/103; 254/102; 254/101; 254/94; 254/DIG. 1

[58] Field of Search ..... 254/92, 94, 98, 254/100, 101, 102, 103, 7 R, DIG. 1, 3 R

[56] References Cited

U.S. PATENT DOCUMENTS

| | | | |
|---|---|---|---|
| 1,065,060 | 6/1913 | Leyner | 254/101 |
| 1,350,970 | 8/1920 | Hutchison et al. | 254/DIG. 1 |
| 1,593,217 | 7/1926 | Lucker | 254/103 |
| 2,057,870 | 10/1936 | Adell | 254/102 |
| 2,096,022 | 10/1937 | Akins | 254/102 |
| 2,096,050 | 10/1937 | Lucker | 254/102 |
| 2,990,159 | 6/1961 | Haferkorn | 254/102 |
| 3,862,577 | 1/1975 | Graafsma et al. | 74/432 |
| 3,862,743 | 1/1975 | Graafsma et al. | 254/100 |
| 3,866,881 | 2/1975 | Graafsma | 254/1 |
| 3,881,692 | 5/1975 | Clarke | 254/101 |
| 3,895,422 | 7/1975 | Graafsma et al. | 29/159.2 |
| 3,941,352 | 3/1976 | Nehrig et al. | 254/98 |
| 3,977,267 | 8/1976 | Graafsma | 74/416 |
| 4,000,880 | 1/1977 | Graafsma | 254/103 |
| 4,015,825 | 4/1977 | Graafsma et al. | 254/DIG. 1 |
| 4,127,343 | 11/1978 | Potter | 403/285 |
| 4,448,392 | 5/1984 | Ladewski | 254/103 |

OTHER PUBLICATIONS

Ausco Products, Inc. advertising brochure "Automotive Screw Jacks that Raise more than Expectations" circa 1993.

Photograph showing an assembled and disassembled jack manufactured by Seeburn Match Products Limited, Tottenham, Canada, for the 1996 Ford F-250 and F-350 SRW.

Photograph showing an assembled and disassembled jack manufactured by Seeburn Match Products Limited, Tottenham, Canada, for the 1996 Toyota Tacoma 4×2.

Photograph showing an assembled and disassembled jack manufactured by Seeburn Match Products Limited, Tottenham, Canada for the 1997 Ford F-150 4×4.

Photograph showing an assembled and disassembled jack manufactured for the 1996 Nisson Pathfinder.

Photograph showing an assembled and disassembled jack manufactured for the 1996 Toyota 4 Runner.

Photograph showing an assembled and disassembled jack manufactured for the 1996 Isuzu 1.5 Ton Pick Up 4×2.

*Primary Examiner*—Timothy V. Eley
*Assistant Examiner*—Lee Wilson
*Attorney, Agent, or Firm*—Renner, Kenner, Greive, Bobak, Taylor & Weber

[57] ABSTRACT

A screw jack (20) includes a stand (21) which houses a side gear (58) which, when rotated, turns a bottom gear assembly (67). An inner screw (73) is connected to the bottom gear assembly (67) and thus turns therewith. Because of an interaction with an outer screw (77), rotation of the inner screw (73) initially causes a tube assembly (24) to move axially relative to a hexagonally shaped sleeve (23). A hex nut (81) is attached to the lower end of the tube assembly (24) to prevent rotation of the tube assembly (24). The nut (81) threadably engages the outer screw (77) and at one stage during the use of the jack (20), the nut (81) also engages a shoulder (82) of the sleeve (23) so that upon continued rotation of the screw (73), the tube assembly (24) and sleeve (23) move axially together. A load bearing assembly (25) is carried at the top of the tube assembly (24) and is adapted to be positioned under the frame or other component of a vehicle to be lifted. When the vehicle is being lifted, the jack (20) is allowed to tilt on selected of feet (48, 49, 50) positioned on the bottom of a base plate (22). The base plate (22) has a plurality of tabs (40) which are folded over edges (37) of a peripheral bottom plate (35) of the stand (21) to attach the base plate (22) to the stand (21). A bearing cup (71) positioned on the base plate (22) receives feet (72) of the bottom gear assembly (67) to floatingly position the bottom gear assembly (67) within the stand (21).

28 Claims, 6 Drawing Sheets

AUTOMOTIVE SCREW JACK

TECHNICAL FIELD

This invention relates to a jack for a vehicle. More specifically, this invention relates to a jack which can engage the frame or other components of a vehicle and which utilizes a telescoping screw assembly to lift the vehicle to aid in changing a tire.

BACKGROUND ART

There are a number of known types of jacks which are employed to lift a vehicle so that a tire can be changed. Jacks which engage the bumper of a vehicle were once popular but have been replaced by jacks which are adapted to engage the frame or other component of the vehicle because of automakers' change in the bumper design of modern vehicles. Typical of such frame-engaging jacks are the scissors jack and the screw jack, the latter being far more popular and reliable particularly for heavier vehicles such as pick-up trucks, vans and the like.

Of primary concern to the automaker is the cost, weight, effectiveness and safety of the screw jack. Since every vehicle is provided with a jack, and with the ever increasing costs of vehicles, the cost of the jack, which is passed along to the consumer, is important. Further, with emphasis on fuel efficiency, automakers are conscientious of every additional pound that goes into a vehicle, and thus the weight of the screw jack is a factor taken into consideration. The problem is, of course, that the desired lower cost and lower weight jack must be capable of safely raising, holding and lowering the vehicle.

Some of the costs associated with prior art screw jacks, and many of the safety factors, reside in the base thereof. In known screw jacks, the bottom stand thereof is attached to the base by a plurality of rivets or bolts. Such add to the cost of the product, both in material and labor.

Also, the base of some prior art jacks rests on the ground on the perimeter thereof which presents a negative safety factor. As the jack raises the vehicle, the vehicle inherently tilts which causes the jack to try to tilt. But because of its aforesaid position on the ground, prior jacks cannot tilt and the concomitant side loads on the jack become potentially dangerous.

Other safety and use problems in prior art screw jacks reside in the configuration of the screw assembly itself and its associated elements. These jacks have a cylindrical inner tube which vertically slides within a cylindrical outer sleeve during the process of raising the vehicle. However, these members must be prevented from rotating relative to each other as other screw components operatively attached thereto are turned. To prevent such relative rotation, the outer sleeve is normally provided with a vertical keyway slot and the inner tube is provided with a small key which rides in that slot. However, such keys and keyways are susceptible to breakage and/or distortion, particularly under high stress conditions, which results in not only a safety problem, but also renders the jack thereafter useless.

Another cost problem with prior art screw jacks is that the traditional bottom gear assembly requires that a ring be welded to the bottom gear. The ring fits inside of a bearing cup at the bottom of the jack and allows the screw assembly of the jack to effectively float to assist in the accommodation of side forces as it raises the vehicle. The use of such a ring, however, adds what has been found to be an unnecessary separate part and can require an additional manufacturing welding step.

Thus, the need exists for a screw jack which is lighter weight and less expensive to manufacture, both in parts and labor, and yet which is safer and more reliable than the prior art screw jacks.

DISCLOSURE OF THE INVENTION

It is therefore, an object of the present invention to provide a screw jack which is less costly to manufacture both in terms of materials and labor.

It is another object of the present invention to provide a screw jack, as above, which despite being less expensive, is safer and easier to operate.

It is a further object of the present invention to provide a screw jack, as above, with a simpler, yet as strong as or stronger, connection between the base and the bottom stand of the jack.

It is an additional object of the present invention to provide a screw jack, as above, with a base having a bottom configured to allow the jack to tilt when in use thereby reducing side stresses on the jack and reducing operating effort.

It is yet another object of the present invention to provide a screw jack, as above, in which the unique configuration of the bottom of the base is oriented so as to anticipate the expected tilting which varies dependent on which side of the vehicle is being lifted.

It is still another object of the present invention to provide a screw jack, as above, in which the outer tube of the screw assembly is formed in a hexagonal shape and the inner cylindrical tube has a hexagonal portion so that the forces resisting the turning torque are transmitted over six large areas.

It is still a further object of the present invention to provide a screw jack, as above, in which the inner tube and outer sleeve can be made of a lighter gage material, without any intricate machining process, and yet be stronger.

It is yet a further object of the present invention to provide a screw jack, as above, in which the ring for the bottom gear is eliminated and replaced by locator feet integrally formed on the bottom gear.

These and other objects of the present invention, as well as the advantages thereof over existing prior art forms which will become apparent from the description to follow, are accomplished by the improvements hereinafter described and claimed.

In general, a screw jack made in accordance with one aspect of the present invention includes a stand which houses a vertically positioned, rotatable first screw which has external threads. A vertically positioned second screw in the stand has internal threads which engage the external threads of the first screw. As such, when the first screw is rotated the second screw is moved vertically. A tube assembly is positioned around the second screw and includes a multi-sided portion having internal threads which engage external threads of the second screw. The tube assembly thus moves vertically when the first screw is rotated. An outer sleeve has the same multi-sided configuration as the portion of the tube assembly and is positioned around that portion so that the tube assembly does not rotate relative to the sleeve.

in accordance with another aspect of the present invention, the stand which houses the operating components of the jack, many of which are described above, includes a peripheral bottom support plate having a plurality of side edges. A base plate which carries the stand has a plurality of tab edges which are folded over selected of the edges of the support plate so that the support plate of the stand is engaged by the base plate.

In yet another aspect of the present invention, the bottom surface of the base plate which carries the stand is provided with a plurality of feet which are adapted to rest on the ground when the jack is in use. The stand is permitted to tilt on selected of the feet when the jack is in use.

In a further aspect of the present invention, a cup is positioned on the plate at the bottom of the stand. A bottom gear assembly has a plurality of feet extending downwardly therefrom which are received in the cup to locate the bottom gear assembly relative to the cup, the stand, and the plate.

A preferred exemplary screw jack incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
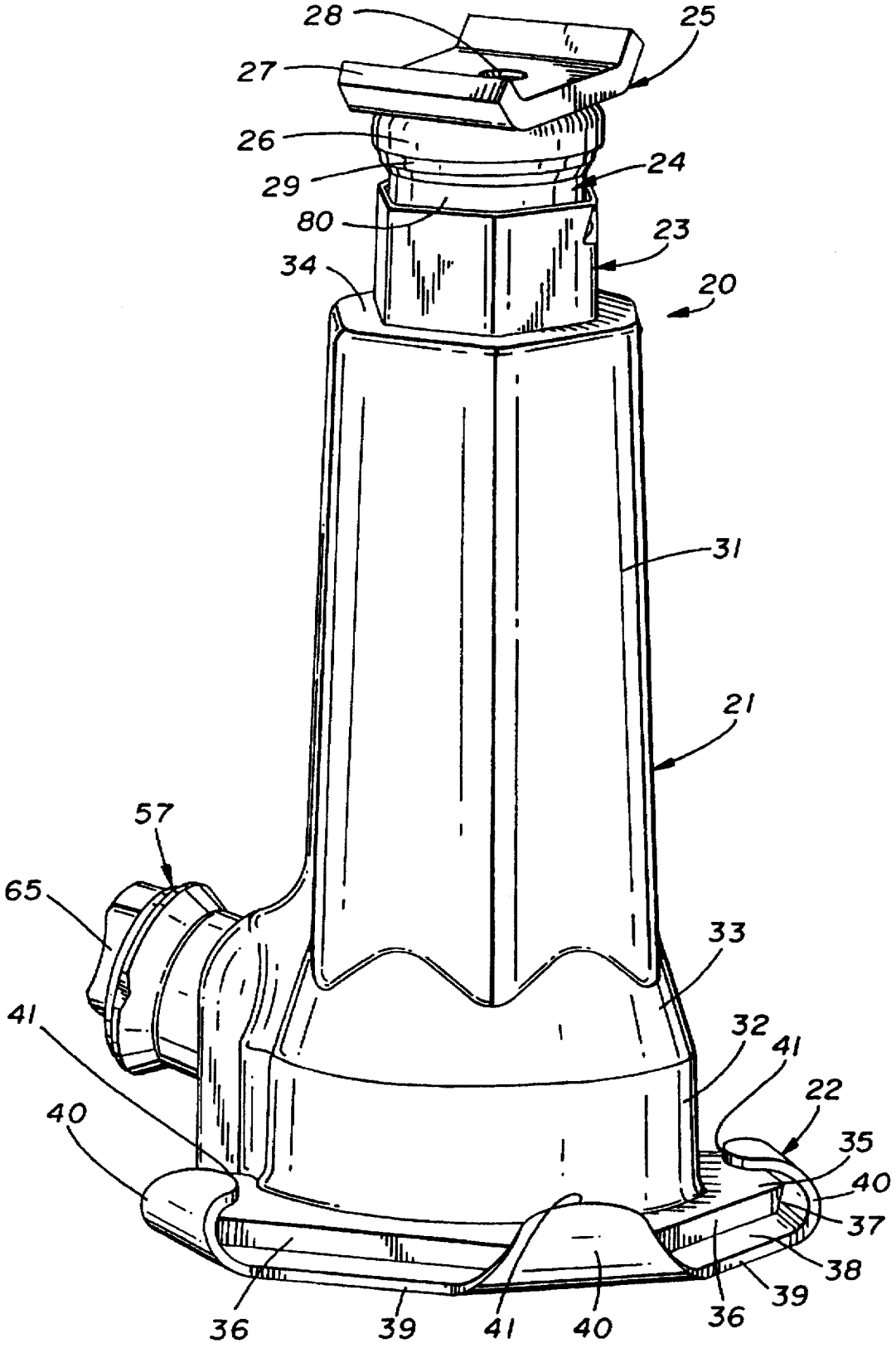
FIG. 1 is a perspective view of a screw jack made in accordance with the concepts of the present invention.
Figure 2:
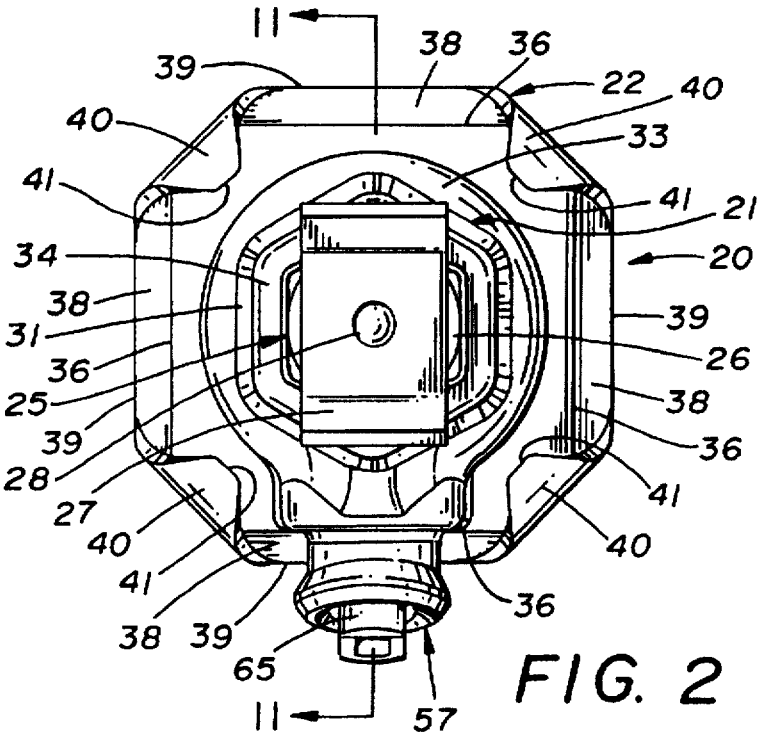
FIG. 2 is a top plan view of the screw jack of FIG. 1.
Figure 3:
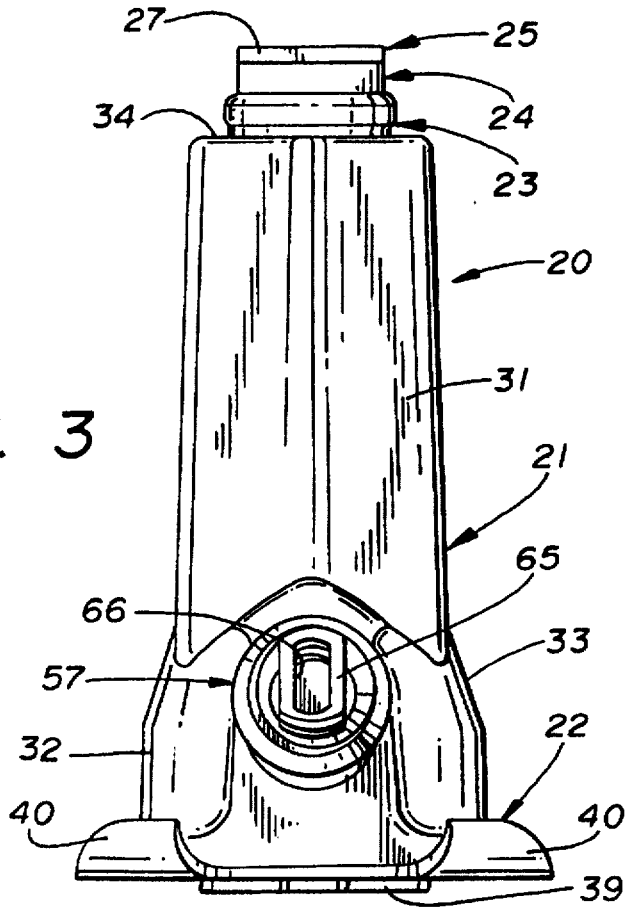
FIG. 3 is a front elevational view of the screw jack of FIG. 1.

A screw jack made in accordance with concepts of the present invention is indicated generally by the numeral 20. Jack 20 includes a stand, indicated generally by the numeral 21, and a base plate, indicated generally by the numeral 22, which is affixed to stand 21. Stand 21 is preferably formed of a high strength aluminum material, and base plate 22 is preferably formed of a high strength, low alloy steel. Jack 20 also includes an hexagonally shaped outer sleeve, indicated generally by the numeral 23 and preferably made of cold rolled steel, and an inner tube assembly indicated generally by the numeral 24 and also preferably made of cold rolled steel. A load bearing assembly, indicated generally by the numeral 25 and preferably made of steel, is the uppermost visible external component of jack 20.

Figure 5:
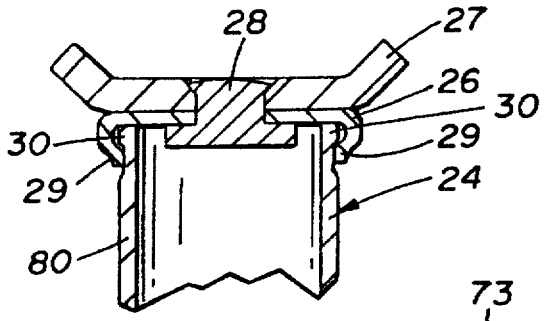
FIG. 5 is a fragmented sectional view taken substantially along line 5—5 of FIG. 4.

As shown most clearly in FIG. 5, load bearing assembly 25 includes a cap 26 which carries a load member 27 as by a rivet 28. When so attached, load member 27 is free to swivel with respect to cap 26 so that it may be properly positioned under the frame or other component of the vehicle to be lifted. The peripheral edge 29 of cap 26 may be crimped over an upper shoulder 30 formed at the top of inner tube assembly 24 to attach load bearing assembly 25 to tube assembly 24.

Stand 21 includes an upstanding hexagonal upper body portion 31 which closely confines hexagonal outer sleeve 23. Stand 21 also includes a lower generally cylindrical housing 32 which is joined to body portion 31 by a transition shoulder 33. A peripheral ledge 34 is formed at the top of body portion 31. Housing 32 is open at the bottom but is integrally formed with and carried by a bottom peripheral plate 35 which is preferably a flat member shown as having eight sides, four longer sides or edges 36 and four shorter sides or edges 37.

Base plate 22 is of the same general peripheral configuration as bottom plate 35 but it is somewhat peripherally larger than bottom plate 35. Base plate 22 thus has a flat upper surface 38 and four longer sides or edges 39 generally corresponding to longer sides 36 of stand bottom plate 35. The shorter sides between longer sides 39 are configured in the form of tabs 40 having outer edges 41. Before assembly, tabs 40 are flat and generally coincident with surface 38. To assemble base plate 22 to stand bottom plate 35, sides 39 are aligned with sides 36 and tabs 40 are aligned with shorter sides 37 of stand bottom plate 35. Then tabs 40 are merely folded or crimped over sides 37, as shown in the drawings, so that outer edges 41 engage the top of stand bottom plate 35 at the area of sides 37, and thus base plate 22 is connected to stand 21 without the need for rivets or bolts as was characterized by the prior art.

Figure 11:
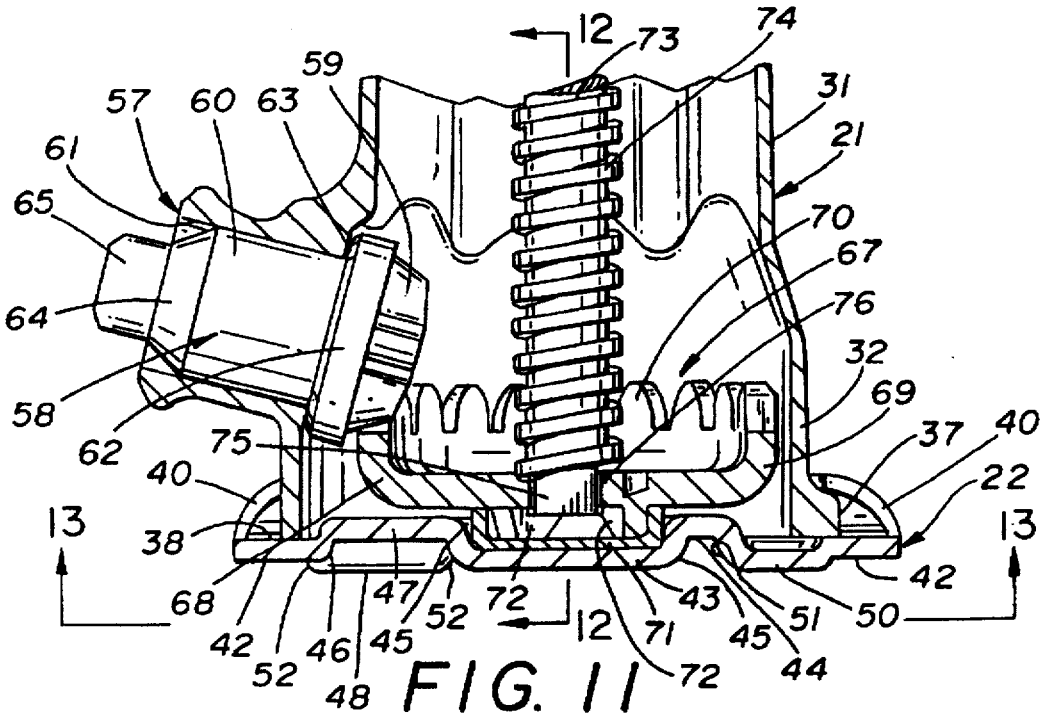
FIG. 11 is a sectional view taken substantially along line 11—11 of FIG. 2.
Figure 12:
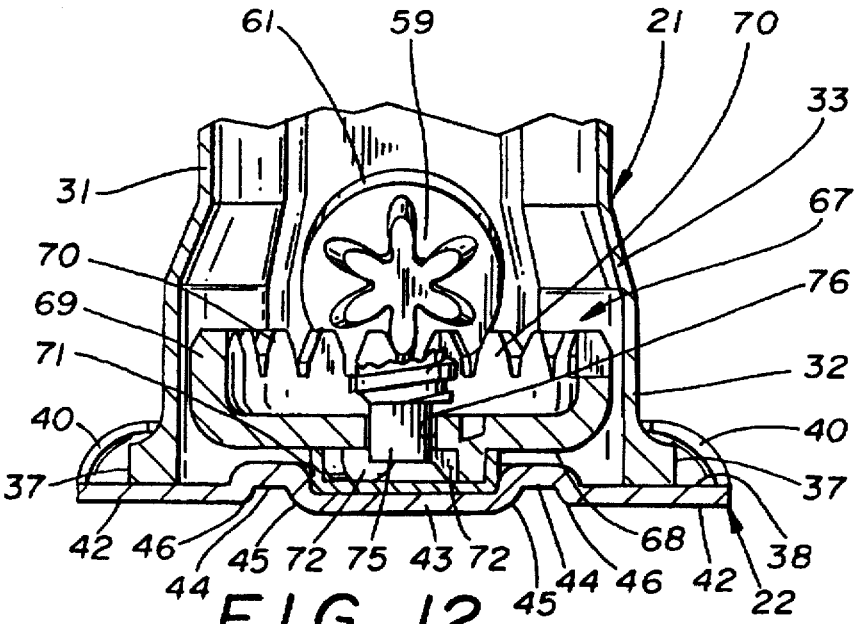
FIG. 12 is a sectional view taken substantially along line 12—12 of FIG. 11.
Figure 13:
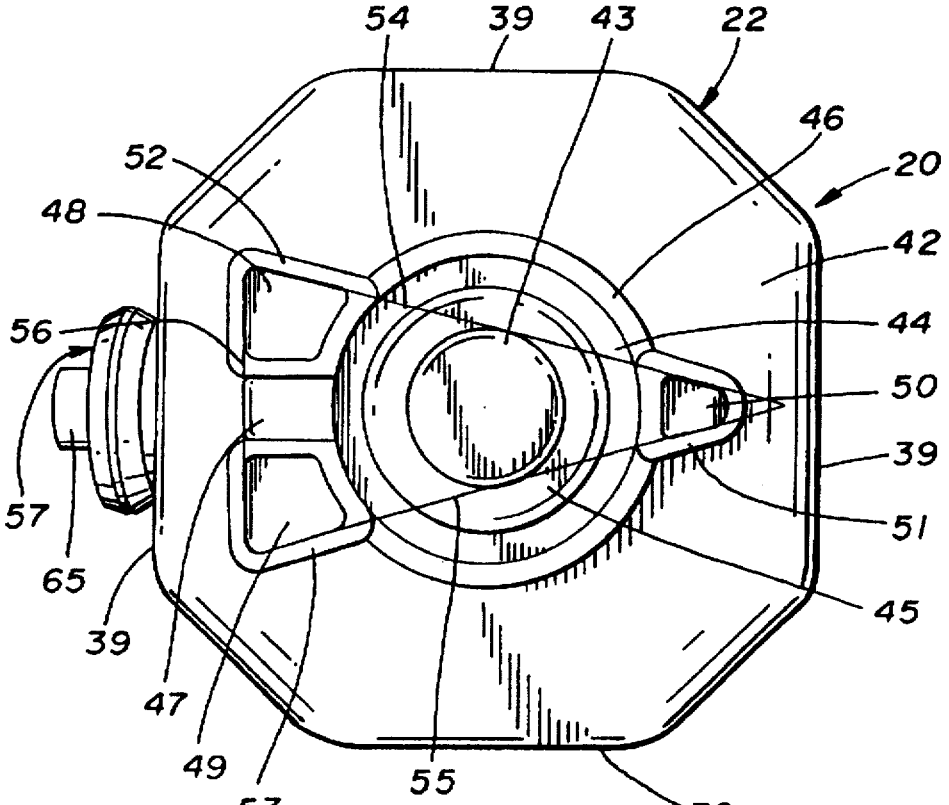
FIG. 13 is a bottom plan view of the screw jack of FIG. 1 taken substantially along line 13—13 of FIG. 11.

The unique bottom of base plate 22 is best shown in FIGS. 11–13. The majority of the bottom surface of base plate 22 is represented as a flat surface 42, but it is not the lowest surface of the bottom of base plate 22. One of the lowest surfaces, which is adapted to rest on the ground when jack 20 is in use, is a hub 43 which has a flat bottom and which is generally circular in plan view. Most of the forces encountered by jack 20 when lifting a vehicle are directed to hub 43 and transmitted to the ground. A generally circular, raised channel 44 is formed at the periphery of hub 43 with a radiused surface 45 defining the transition between hub 43 and channel 44 and another radiused surface 46 defining the transition between channel 44 and surface 42. Another raised area 47 (FIGS. 11 and 13) is positioned tangentially of, and extends generally radially outward of, channel 44.

Three lower pads or flat foot surfaces 48, 49, 50 are provided and are in the same plane as the bottom of hub 43. Thus, with hub 43, feet 48, 49, 50 define the other lowermost surfaces of base plate 22, and thus, like hub 43, are adapted to rest on the ground when jack 20 is in use. Hub 43 and feet 48, 49 and 50 thus maintain surface 42 slightly above the ground when jack 20 is in use. Foot surface 50 is at the bottom of a radiused leg 51 extending from surface 42 and channel 44; foot surface 48 is at the bottom of a radiused leg 52 extending from surface 42, channel 44, and recessed area 47; and foot surface 49 is at the bottom of a radiused leg 53 also extending from surface 42, channel 44, and recessed area 47.

The outermost surfaces of base plate 22 which support jack 20 are thus feet surfaces 48, 49 and 50 which define a isosceles triangle have sides defined by a line 54 (between surfaces 48 and 50), a line 55 between surfaces 49 and 50) and a line 56 (between surfaces 48 and 49). The angle between lines 54 and 55 is preferably about 30° and therefore the angles between line 56 and lines 54 and 55 are preferably about 75°.

Stand 21 includes side gear access port assembly, generally indicated by the numeral 57 to be hereinafter described, which is positioned midway between feet 48 and 49 that is, its axis bisects line 56 and is on a radius of hub 43, as viewed in FIG. 13. As such, when jack 20 is placed under a vehicle, foot surface 50 is furthest under the vehicle and the user, of course, will have access to port assembly 57. Although jack 20 will rest very stably on hub 43 and feet 48, 49 and 50, during the lifting process, to be hereinafter described, side loads on jack 20 may cause it to want to tilt. Unlike the prior art, as previously described, jack 20 accommodates such tilting. If jack 20 is inserted under the vehicle on the driver's side, it is allowed to tilt on feet 48 and 50, that is, on an axis defined by line 54, and if it is under the vehicle on the passenger side, it can tilt on feet 49 and 50, that is, on an axis defined by line 55. Such keeps the load centered and reduces side stresses on the internal components of jack 20 now to be described.

Essentially all of the operating components of jack 20, except for load bearing assembly 25, are telescopically received within or otherwise housed by stand 21. One such component is a side gear generally indicated by the numeral 58, best shown in FIGS. 10 and 11, and positioned in side gear access port assembly 57. Side gear 58 includes gear teeth 59 carried by a shank 60. Shank 60 is received through a bore 61 which is part of assembly 57 and which is formed in stand 21. A shoulder 62 formed on shank 60 rests against a corresponding shoulder 63 formed on the inside of stand 21 at the opening to bore 61. The outer end of shank 60 includes a necked-down surface 64 which serves as the transition between shank 60 and a side gear drive member 65. Drive member 65 is provided with a rectangular bore 66 therein which is adapted to receive a conventional jack handle. Thus, when such a handle is inserted into bore 66, side gear 58 may be rotated which, in turn, rotates a bottom gear assembly, generally indicated by the numeral 67, in a bevel gear-like fashion.

Figure 10:
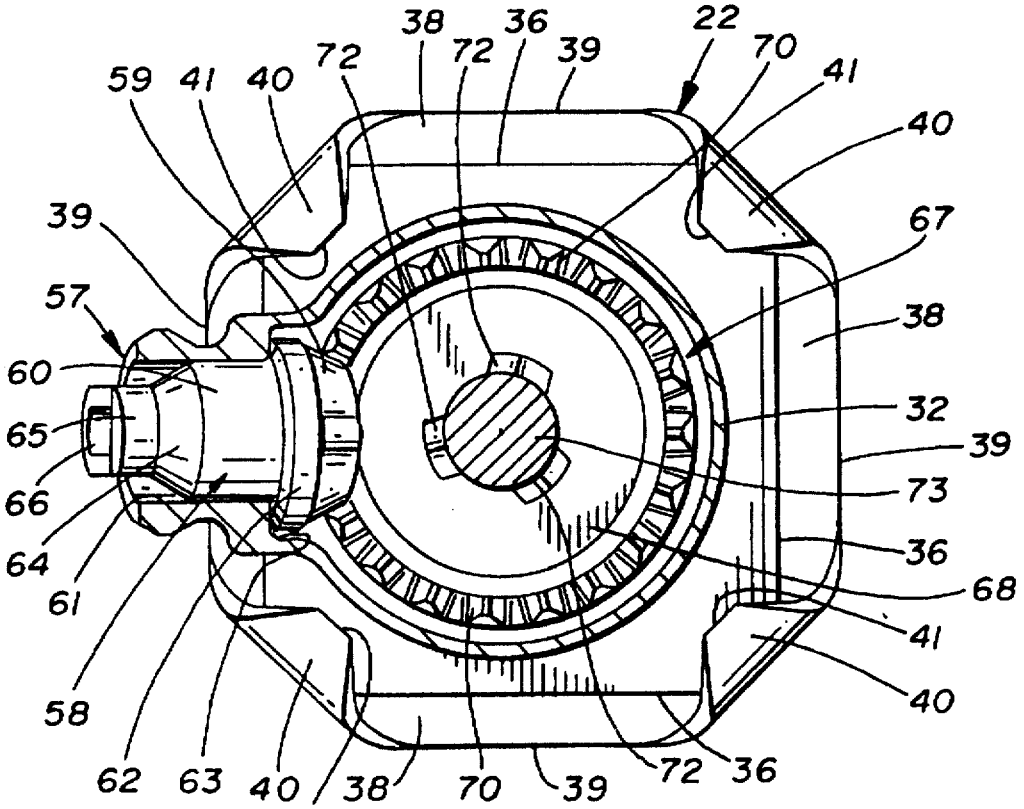
FIG. 10 is a sectional view taken substantially along line 10—10 of FIG. 4.

Bottom gear assembly 67 includes a cup-like member having a base 68 and a peripheral, upstanding, generally cylindrical sidewall 69. A plurality of gear teeth 70 are formed at the top of sidewall 69 to mesh with teeth 59 of side gear 58. Bottom gear assembly 67 is positioned in a bearing cup 71 which freely rests within hub 43 of base plate 22. A plurality of locator feet 72, preferably three as shown in FIG. 10, extend downwardly from base 68 and rest within the confines of bearing cup 71. Feet 72 are generally arcuate in nature and together define a circle whose outer diameter approximates the inner diameter of bearing cup 71 thereby serving to positively locate bottom gear assembly 67 within stand 21. However, bearing cup 71 and bottom gear assembly 67 are free to float or slightly wobble. Any side forces on the operating components which may remain after the configuration of the bottom of base plate 22 has reduced most, if not all, side forces, as previously described, are thus accommodated.

In particular, one such operating component is an inner screw at first screw 73 having external threads 74 and a short square shaft 75 at the bottom thereof. Shaft 75 fits within a corresponding square socket 76 formed generally at the center of base 68 of bottom gear assembly 67 so that as gear assembly 67 rotates, inner screw 73 is turned.

Inner screw 73 extends upwardly through the majority of the height of jack 20 and it engages an outer screw at second screw 77 which is of generally the same length. To that end, a short length near the bottom of outer screw 77 is provided with internal threads 78 which are engaged by threads 74 of inner screw 73. As such, as screw 73 rotates, outer screw 77 is caused to move upwardly or downwardly. Outer screw 77 is also provided with external threads 79 extending along its entire length.

Inner tube assembly 24 includes a cylindrical tube 80 which, as previously described, has shoulder 30 formed at the top thereof for assisting in engaging load bearing assembly 25. Inner tube assembly 24 includes a multi-sided portion preferably in the form of a conventional hex nut 81 (FIG. 7) which may be welded to the lower axial end of to be 80 to engage the external threads 79 of outer screw 77. Nut 81 and tube 80 are prevented from rotating because the hex nut 81 is closely received within hexagonal outer sleeve 23 and, unlike the prior art, offers six areas of resistance to the forces attempting to rotate tube 80. As such, when inner screw 73 rotates to axially move outer screw 77, inner tube assembly 24 is likewise moved axially. It should also be understood that the hex nut 81 could be replaced by any multi-sided member which could also be formed integrally with tube 80. Moreover, because of this unique arrangement, inner tube assembly 24 and outer sleeve 23 may be made of a lighter gage material and yet be stronger than prior art forms.

Figure 4:
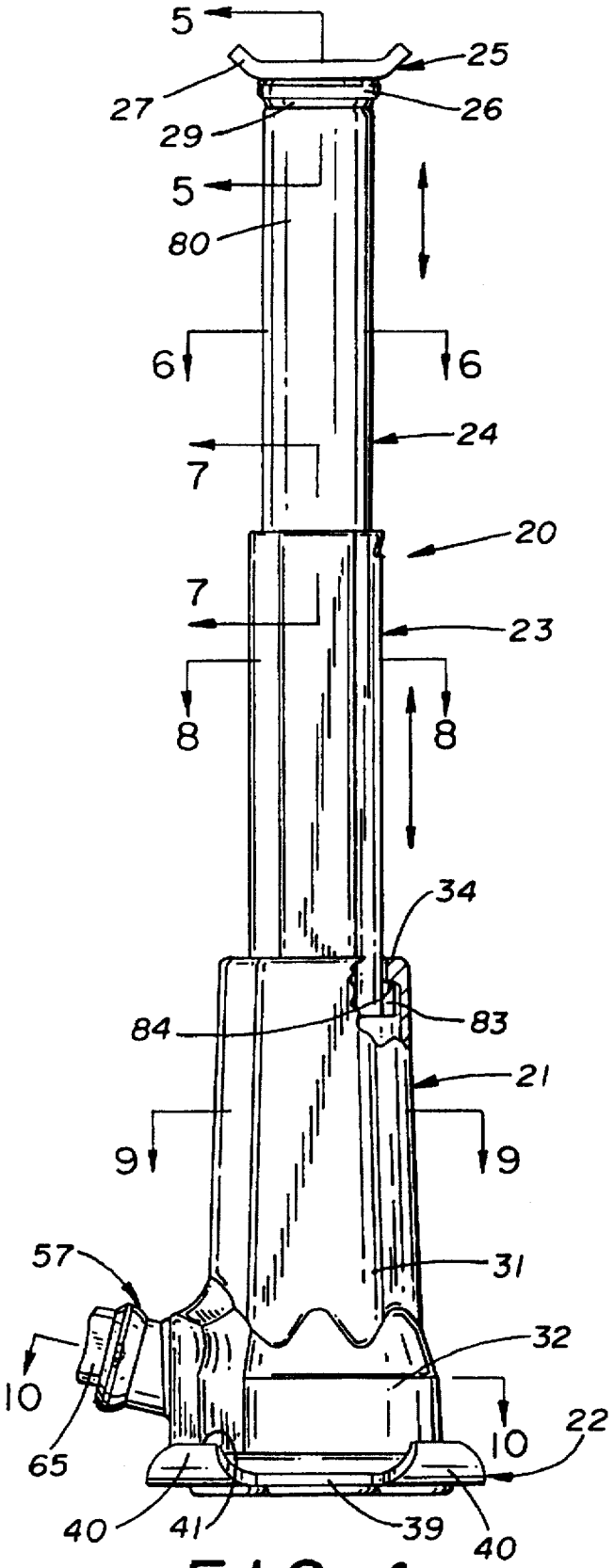
FIG. 4 is a partially broken away side elevational view showing the screw jack of FIG. 1 vertically extended.
Figure 6:
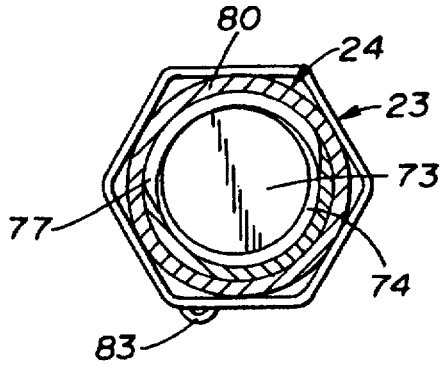
FIG. 6 is a sectional view taken substantially along line 6—6 of FIG. 4.
Figure 7:
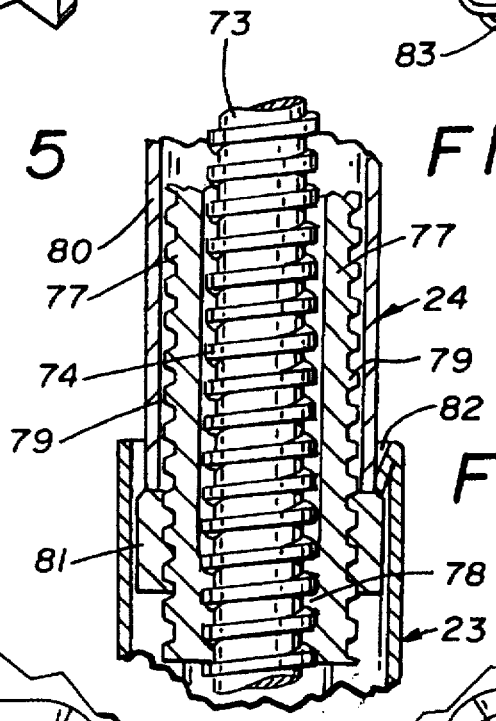
FIG. 7 is a fragmented sectional view taken substantially along line 7—7 of FIG. 4.
Figure 8:
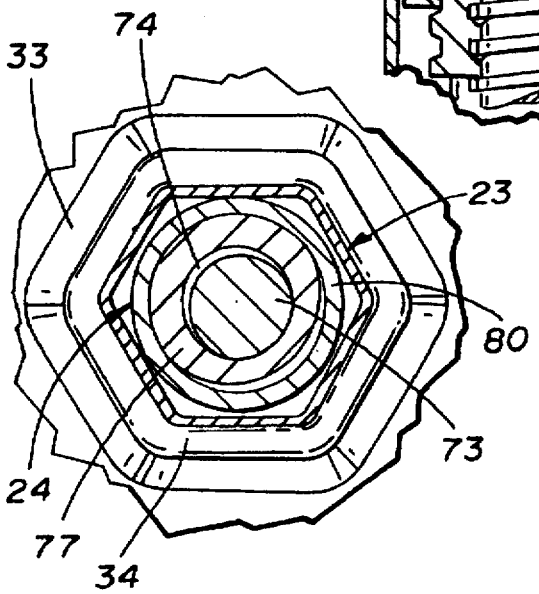
FIG. 8 is a fragmented sectional view taken substantially along line 8—8 of FIG. 4.
Figure 9:
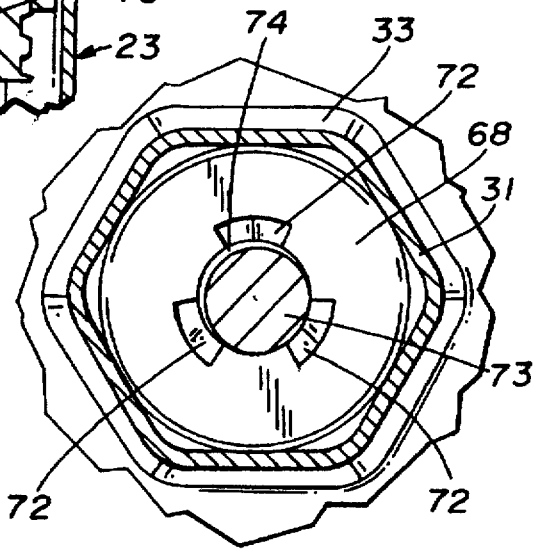
FIG. 9 is a fragmented sectional view taken substantially along line 9—9 of FIG. 4.

In summary as to the operation of jack 20, with load member 27 under the appropriate frame of the vehicle, side gear 58 is rotated by means of a conventional tool inserted into rectangular bore 66 and turned. Such rotates the free floating bottom gear assembly 67 which, in turn, turns inner screw 73. Initially, the rotation of inner screw 73 causes relative axial movement between inner tube assembly 24 and outer sleeve 23. That is, inner tube assembly 24 moves upwardly relative to outer sleeve 23 with nut 81 sliding against the walls of outer sleeve 23. When inner tube assembly 24 has moved to its fullest axial extent, as shown in FIG. 7, nut 81 engages an internal shoulder 82 formed at the top of outer sleeve 23. This engagement not only maintains inner tube assembly 24 axially within outer sleeve 23, but also, upon continued rotation of inner screw 73, inner tube assembly 24 and outer sleeve 23 now move axially together. Thus, outer sleeve 23 moves axially with respect to stand 21 until jack 20 reaches its fully extended position shown in FIG. 4. At this time further upward movement is prevented, and outer sleeve 23 is maintained in stand 21, because, as shown in FIGS. 4 and 6, a stop lug 83, which extends outwardly from outer sleeve 23, engages a shoulder 84 formed beneath ledge 34 of stand 21. Throughout the upward movement of all components, side forces which may be exerted on jack 20 are accommodated by the ability of jack 20 to tilt slightly on its unique base plate 22.

It should thus be appreciated that an automotive screw jack constructed in accordance with the present invention, as described above, accomplishes the objects of the present invention and otherwise substantially improves the art.

I claim:

1. A jack comprising a stand, a first screw generally vertically positioned in and rotatable within said stand, said first screw having external threads, a second screw generally vertically positioned in said stand and having internal threads engaging said external threads of said first screw such that when said first screw is rotated, said second screw is moved vertically, said second screw also having external threads, a tube assembly positioned around said second screw, a nut carried at the axial bottom of said tube assembly having a hexagonal outer configuration and having internal threads engaging said external threads of said second screw, said tube assembly being moveable vertically when said first screw is rotated, and an outer sleeve having a hexagonal configuration and positioned around said nut.

2. A jack according to claim 1 further comprising an internal shoulder formed near the top of said sleeve, said portion of said tube assembly being engageable with said shoulder so that after said tube assembly moves vertically and said portion of said tube assembly engages said shoulder, said tube assembly and said sleeve move vertically together.

3. A jack according to claim 2 further comprising an internal shoulder formed near the top of said stand, a stop lug extending outwardly from near the bottom of said sleeve, said stop lug engaging said shoulder of said stand to stop the vertical movement of said tube assembly and said sleeve.

4. A jack according to claim 1, said stand having an upper body with a hexagonal configuration to receive said sleeve.

5. A jack according to claim 1 further comprising a rotatable bottom gear, said bottom gear carrying said first screw so that upon rotation of said bottom gear, said first screw rotates.

6. A jack according to claim 5 further comprising a rotatable side gear engaging said bottom gear such that upon rotation of said side gear, said bottom gear rotates.

7. A jack according to claim 6 further comprising a side gear drive member accessible through an opening in said stand.

8. A jack according to claim 7 further comprising a load bearing member carried near the top of said tube assembly.

9. A jack according to claim 1 further comprising a base plate carrying said stand, said base plate having a bottom surface, and a plurality of feet formed on said bottom surface and adapted to rest on the ground when the jack is in use, said stand being permitted to tilt on selected of said feet when the jack is in use.

10. A jack according to claim 9 further comprising a cup positioned on said base plate, and a bottom gear assembly carrying said first screw, said bottom gear assembly including a plurality of feet downwardly depending therefrom and adapted to be positioned in said cup to locate said bottom gear assembly relative to said cup, said stand, and said base plate.

11. A jack according to claim 1 further comprising a plate at the bottom of said stand, a cup positioned on said plate, and a bottom gear assembly carrying said first screw, said bottom gear assembly including a plurality of feet downwardly depending therefrom and adapted to be positioned in said cup to locate said bottom gear assembly relative to said cup, said stand, and said plate.

12. A jack comprising a stand having a peripheral bottom support plate having a plurality of side edges, a base plate for carrying said stand, said base plate having a plurality of tab edges which are foldable over selected of said plurality of said side edges of said support plate so that said support plate is engaged by said base plate, a first screw generally vertically positioned in and rotatable within said stand, said first screw having external threads, a second screw generally vertically positioned in said stand and having internal threads engaging said external threads of said first screw such that when said first screw is rotated, said second screw is moved vertically, said second screw also having external threads, a tube assembly positioned around said second screw, said tube assembly including a multi-sided portion having internal threads engaging said external threads of said second screw, said tube assembly being moveable vertically when said first screw is rotated, and an outer sleeve having the same multi-sided configuration as said portion of said tube assembly and positioned around said portion of said tube assembly.

13. A jack according to claim 12 wherein said base plate has a bottom surface and a plurality of feet formed on said bottom surface and adapted to rest on the ground when the jack is in use, said stand being permitted to tilt on selected of said feet when the jack is in use.

14. A jack according to claim 12 further comprising a cup positioned on said base plate, and a bottom gear assembly carrying said first screw, said bottom gear assembly including a plurality of feet downwardly depending therefrom and adapted to be positioned in said cup to locate said bottom gear assembly relative to said cup, said stand, and said base plate.

15. A jack comprising a stand for housing operating components of the jack, said stand having a bottom support plate having a plurality of side edges, a base plate for caring said stand, said base plate having a plurality of tab edges which are foldable over selected of said plurality of said edges of said support plate so that said support plate is engaged by said base plate.

16. A jack according to claim 15 wherein said support plate includes longer side edges and shorter side edges, said tab edges being foldable over said shorter side edges.

17. A jack according to claim 15 wherein the bottom of said stand is open and said base plate closes said open bottom.

18. A jack according to claim 15 wherein said base plate is larger than said support plate and said base plate is of the same general configuration as said support plate.

19. A jack according to claim 15 wherein said base plate has a bottom surface and a plurality of feet formed on said bottom surface and adapted to rest on the ground when the jack is in use, said stand being permitted to tilt on selected of said feet when the jack is in use.

20. A jack according to claim 15 further comprising a cup positioned on said base plate, one of said operating components being a bottom gear assembly, said bottom gear assembly including a plurality of feet downwardly depending therefrom and adapted to be positioned in said cup to locate said bottom gear assembly relative to said cup, said stand, and said base plate.

21. A jack according to claim 20 wherein said base plate has a bottom surface and a plurality of feet formed on said bottom surface and adapted to rest on the ground when the jack is in use, said stand being permitted to tilt on selected of said feet when the jack is in use.

22. A jack comprising a stand for housing operating components of the jack, a base plate carrying said stand, said base plate having a bottom surface, and a plurality of feet formed on said bottom surface and adapted to rest on the ground when the jack is in use, said plurality of feet including a first foot, a second foot, and a third foot oriented on said base plate in the form of an isosceles triangle, the shorter side of which is between said second and third feet, said stand being thereby permitted to tilt on selected of said feet when the jack is in use.

23. A jack according to claim 22 further comprising a generally circular hub extending downwardly from said bottom surface between said feet and having a lower surface adapted to rest on the ground when the jack is in use.

24. A jack according to claim 22 wherein one of said operating components is a side gear, said stand having a port providing access to said side gear, said port being positioned generally midway between said second and third feet such that when the jack is in use it may tilt either on said first and second feet or said first and third feet.

25. A jack according to claim 22 further comprising a cup positioned on said base plate, one of said operating components being a bottom gear assembly, said bottom gear assembly including a plurality of feet downwardly depending therefrom and adapted to be positioned in said cup to locate said bottom gear assembly relative to said cup, said stand, and said base plate.

26. A jack comprising a stand for housing operating components of the jack, a plate at the bottom of said stand, a cup positioned on said plate, one of said operating components being a bottom gear assembly, said bottom gear assembly including a plurality of feet downwardly depending therefrom and positioned in said cup to locate said bottom gear assembly relative to said cup, said stand, and said plate.

27. A jack according to claim 26 wherein said feet are arcuate in configuration and together define a circle whose outer diameter approximates the inner diameter of said cup.

28. A jack comprising a stand, a first screw generally vertically positioned in and rotatable within said stand, said first screw having external threads, a bottom gear assembly carrying said first screw, a second screw generally vertically positioned in said stand and having internal threads engaging said external threads of said first screw such that when said first screw is rotated, said second screw is moved vertically, said second screw also having external threads, a tube assembly positioned around said second screw, said tube assembly including a multi-sided portion having internal threads engaging said external threads of said second screw, said tube assembly being moveable vertically when said first screw is rotated, and an outer sleeve having the same multi-sided configuration as said portion of said tube assembly and positioned around said portion of said tube assembly, said stand having a peripheral bottom support plate having a plurality of side edges, a base plate for carrying said stand, said base plate having a plurality of tab edges which are foldable over selected of said plurality of said side edges of said support plate so that said support plate is engaged by said base plate, said base plate having a bottom surface and a plurality of feet formed on said bottom surface adapted to rest on the ground when the jack is in use, said stand being permitted to tilt on selected of said feet when the jack is in use, and a cup positioned on said base plate, said bottom gear assembly including a plurality of feet downwardly depending therefrom and adapted to be positioned in said cup to locate said bottom gear assembly relative to said cup, said stand, and said base plate.

* * * * *